US012758821B2

(12) United States Patent
Smith

(10) Patent No.: US 12,758,821 B2
(45) Date of Patent: Oct. 13, 2026

(54) BAREFOOT TRAINING AND EXERCISE DEVICE

(71) Applicant: In Step Physical Therapy and Biomechanics, PLLC, Albany, NY (US)

(72) Inventor: William J. Smith, Albany, NY (US)

(73) Assignee: In Step Physical Therapy and Biomechanics PLLC, Albany, NY (US)

( * ) Notice: Subject to any disclaimer, the term of this patent is extended or adjusted under 35 U.S.C. 154(b) by 162 days.

(21) Appl. No.: 18/746,435

(22) Filed: Jun. 18, 2024

(65) Prior Publication Data

US 2024/0424341 A1 Dec. 26, 2024

Related U.S. Application Data

(60) Provisional application No. 63/509,124, filed on Jun. 20, 2023.

(51) Int. Cl.
*A63B 23/10* (2006.01)
*A63B 22/18* (2006.01)

(52) U.S. Cl.
CPC ..... *A63B 23/10* (2013.01); *A63B 22/18* (2013.01); *A63B 2022/185* (2013.01)

(58) Field of Classification Search
CPC ..... A63B 23/08; A63B 23/085; A63B 23/10; A63B 22/18; A43B 13/145
See application file for complete search history.

(56) References Cited

U.S. PATENT DOCUMENTS

| | | | | |
|---|---|---|---|---|
| 7,500,324 | B1 * | 3/2009 | Power | A43B 13/145 482/79 |
| 8,397,404 | B2 * | 3/2013 | Kim | A43B 17/00 482/79 |
| 9,232,829 | B2 * | 1/2016 | Breach | G09B 19/0038 |
| 12,484,655 | B2 * | 12/2025 | Livne | A43B 7/1415 |
| 2016/0310308 | A1 * | 10/2016 | Ferri | A61F 5/10 |

* cited by examiner

*Primary Examiner* — Zachary T Moore
(74) *Attorney, Agent, or Firm* — Hoffman Warnick LLC

(57) ABSTRACT

An exercise device and associated methods that in configurable in either a glider mode or a balance mode. The device includes: a footbed having a toe separator, a chassis having a first surface mated to the footbed and a second opposed surface having a plurality of attachment points; a strap configured to secure a foot onto the footbed; and at least one balance dome releasably attachable to a selected attachment point.

17 Claims, 6 Drawing Sheets

BAREFOOT TRAINING AND EXERCISE DEVICE

PRIORITY CLAIM

This application claims priority to provisional application 63/509,124 filed on Jun. 23, 2023, BAREFOOT TRAINING AND EXERCISE DEVICE, the contents of which are incorporated by reference.

TECHNICAL FIELD

The subject matter of this disclosure relates to exercise and training devices, and more particularly, a barefoot training and exercise device that is configurable in either a glider mode or a balance mode.

BACKGROUND

"Barefoot training" is a growing trend in the fitness world, and can increase muscle strength and endurance, stability, proprioception, and coordination. Barefoot training can also be essential for recovery from foot and ankle injury as well as preventative care for an active aging population through strengthening their foot and ankle regions. Devices, such as balance boards (which can include rocker boards and wobble boards) are a fitness tool you can stand on while performing exercises to help improve balance and posture, aid in rehabilitation, prevent lower body injuries, and increase core strength. Other fitness tools such as gliders (also referred to as glide discs) allow a user to slide their feet on a flooring surface utilized with barefoot training can improve results. However, balance boards and gliders can require a certain level of skill to become proficient and therefore may not be suitable for certain users. Furthermore, devices such as balance boards are large and cumbersome, which makes them difficult to transport.

SUMMARY

Aspects of the disclosure provide a barefoot exercise and training device and methods of using the same that can be configured in either a balance mode or a glider mode. The device includes a toe separating foot bed with a strap for securing a user's foot, as well as removably attachable balance domes, thus providing ease of use and a complete system for strengthening the foot and ankle.

A first aspect provides an exercise device that includes: a footbed having a toe separator; a chassis having a first surface mated to the footbed and a second opposed surface having a plurality of attachment points; a strap configured to secure a foot onto the footbed; and at least one balance dome releasably attachable to a selected attachment point.

A second aspect provides a method of utilizing an exercise device that includes: providing an exercise device having a footbed having a toe separator, and a chassis having a plurality of attachment points on an opposed surface from the footbed; attaching at least one balance dome to a selected attachment point on the opposed surface; strapping the foot onto the footbed, wherein a first toe and second toe are separated by the toe separator; and performing a balance mode exercise. In a further aspect, the balance dome(s) are removed and a glider exercise is performed.

BRIEF DESCRIPTION OF THE DRAWINGS

These and other features will be more readily understood from the following detailed description of the various aspects taken in conjunction with the accompanying drawings in which.

Figure 2:
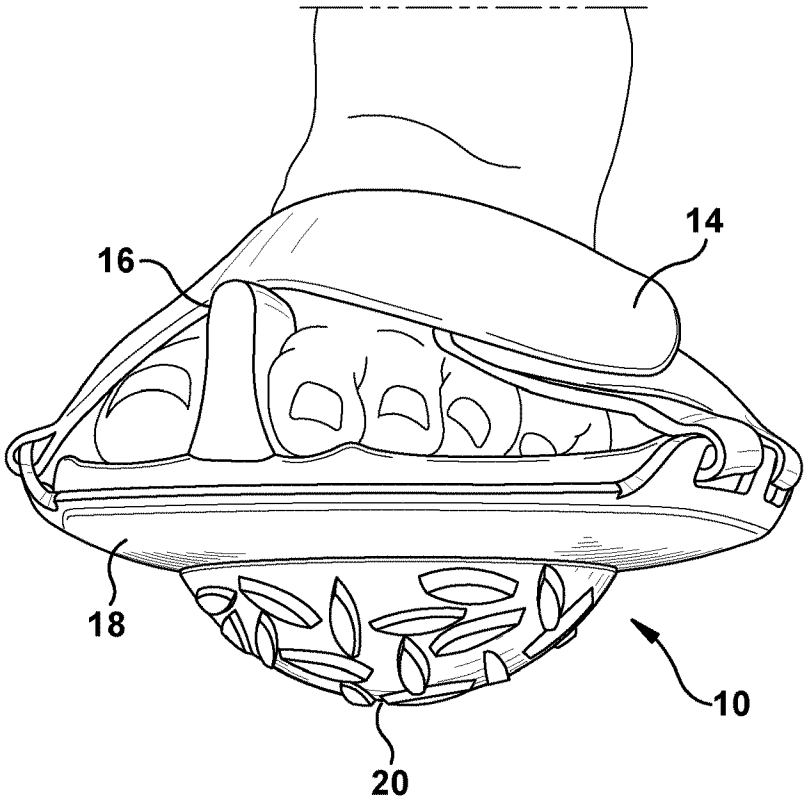
FIG. 2 shows a foot strapped into the exercise device of FIG. 1 according to embodiments.

The drawings are not necessarily to scale. The drawings are merely schematic representations, not intended to portray specific parameters of the invention. The drawings are intended to depict only typical embodiments of the invention, and therefore should not be considered as limiting the scope of the invention. In the drawings, like numbering represents like elements.

DETAILED DESCRIPTION

Various embodiments provided herein relate to a barefoot exercise and training device, and methods of using the same for strengthening foot and ankle muscles. In certain aspects, a pair of devices (one for each foot) may be utilized by a user. Each device includes a toe separating foot bed with a support strap for maintaining the user's foot in a proper position. The device can be configured in a glider mode or in a balance mode. The device includes a smooth bottom surface to allow for use in a glider mode. To operate in the balance mode, adjustable balance domes can be attached to the bottom surface to provide a wobble board experience. Both modes allow for barefoot exercises in an ergonomically supported position, thereby enabling multiple balance and strengthening activities for all fitness and age levels. Furthermore, the support strap allows the user to perform static or dynamic activities with both feet at the same time, while sitting or standing.

Figure 1:
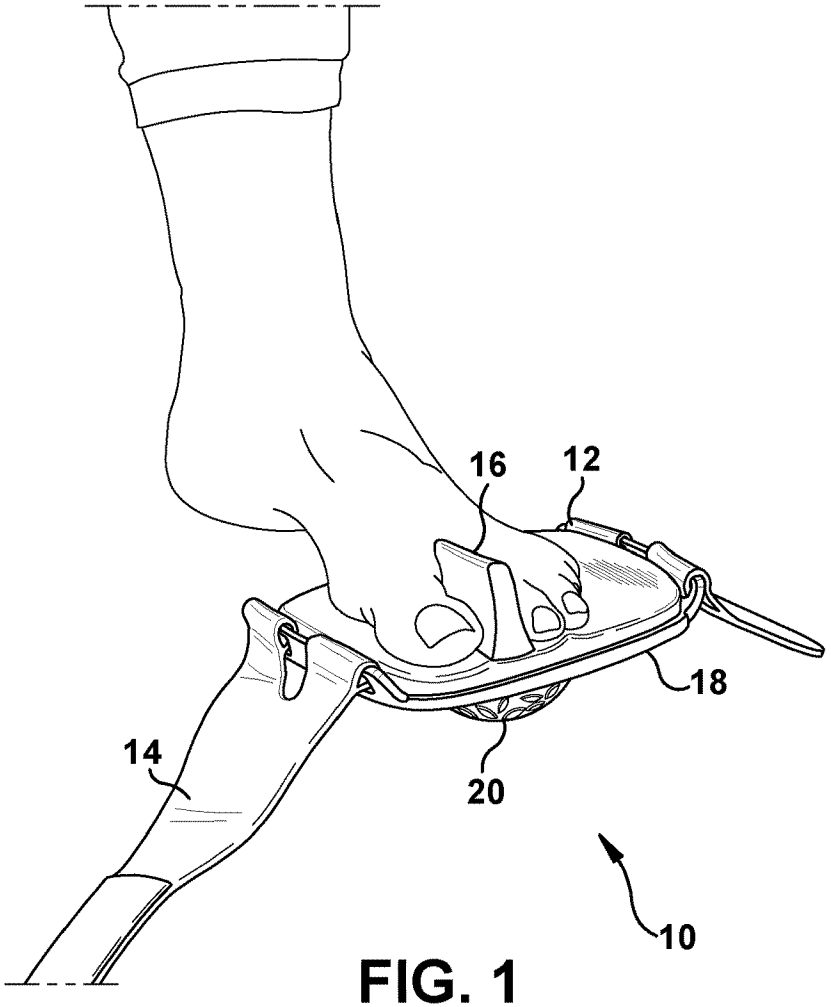
FIG. 1 shows an unstrapped foot placed on an exercise device according to embodiments.

FIG. 1 depicts an illustrative embodiment of an exercise and training device (hereafter "exercise device") 10 with a user's foot place thereon prior to support strap 14 being engaged about the user's foot. FIG. 2 shows exercise device 10 with the support strap 14 engaged on the user's foot. Note that in this illustrative embodiment, the support strap 14 utilizes a hook and loop fastener (e.g., VELCRO®) for engagement, however, other engagement systems could be utilized, e.g., snaps, buttons, hooks, laces, etc. Exercise device 10 generally includes: an ergonomic footbed 12 with a toe separator 16 dimensioned and shaped to slide between the first (large toe) and second toe; support strap 14; a rigid chassis 18; and one or more balance domes 20 attachable to the underside of chassis 18. As shown in FIGS. 1 and 2, the device 10 is configured in the balance mode with a balance dome 20 attached thereto.

Support straps 14 include a pair of wings that extend from opposing edges of the chassis 18, and wrap over the top (i.e., dorsal) portion of the user's foot seated in the footbed 12. Support straps 14 may include padded material and hook and loop fasteners or any other releasably attachable fasteners to wrap over and engage a user's foot. The embodiment depicted in FIGS. 1 and 2 show a device 10 configured for a user's left foot. A second device (not shown) for the right foot would be similar but opposite, i.e., with the toe separator 16, footbed 12 and strap 14 configured for the right foot.

Figure 3:
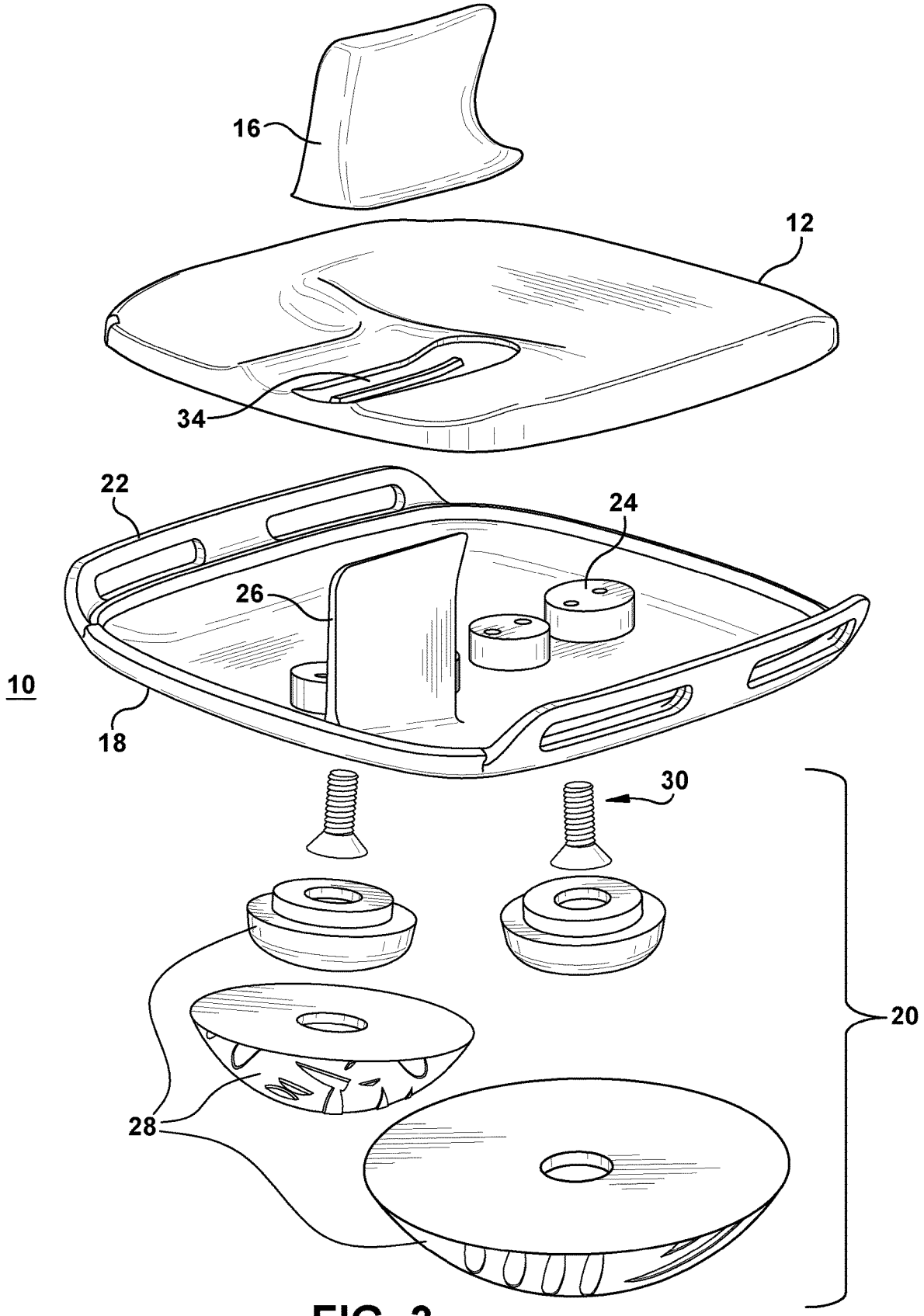
FIG. 3 shows an exploded view of the exercise device according to embodiments.

FIG. 3 depicts an exploded view of the illustrative exercise device 10. As shown, chassis 18 includes a first (top) surface that includes a toe separator column 26, a set of recessed fixtures 24 that provides threaded openings (not shown) on a second opposed (i.e., underside) surface of the chassis 18, and strap anchors 22. Footbed 12 mates to the top surface of chassis 18 and include a slit 34 through which toe separator column 28 passes when mated. The toe separator 16 slidably engages over toe separator column 28. One or more balance domes 20 can be releasably attached to the underside of chassis 18 by the user for use in the balance mode. Each balance dome 20 includes a first side with a threaded bolt 30 that extends from a planar surface and a second semi-hemispherical shaped side 28.

Figure 4:
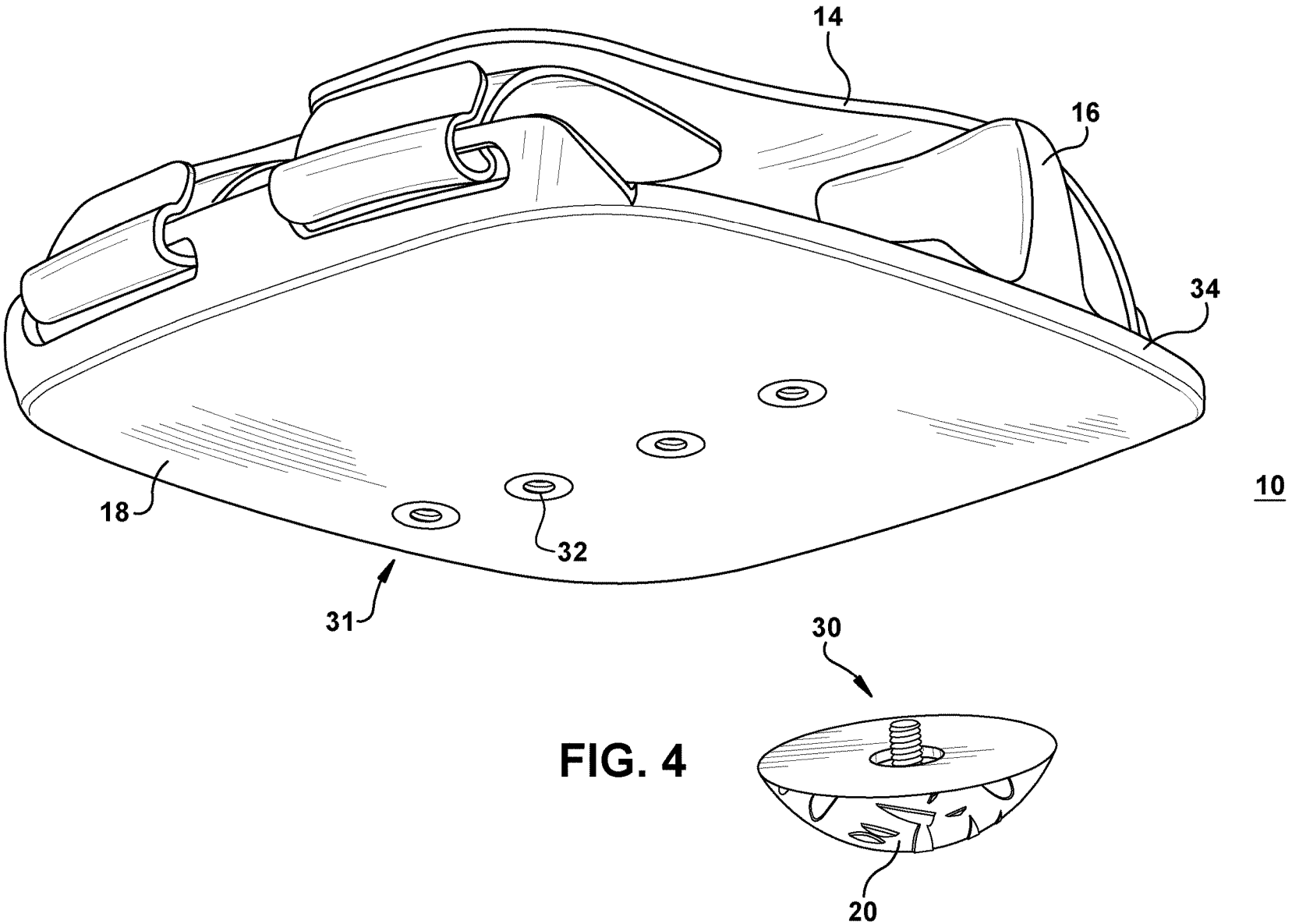
FIG. 4 shows the underside of the exercise device according to embodiments.

FIG. 4 depicts an underside view of excise device 10. In this embodiment, there are four attachment points 31 at which balance dome 20 can be selectively attached and removed by the user threaded openings 32. In this embodiment, each attachment point 31 in the underside of chassis 18 includes a recessed opening, and each recessed opening includes a threaded cylinder 32 for receiving a threaded bolt 30 on an associated balance dome 20. While this embodiment utilizes a threaded bolt 30 and threaded cylinders 32 for attaching balance domes 20, it is understood that other attachment mechanisms could be utilized, e.g., a twist spring lock, a magnetic rod, a shaped plug, etc.

Domes 20 may be provided in different sizes, shapes, materials, densities, hardness rating (e.g., different durometer ratings) for varied difficulty levels during exercise and training. The balance domes 20 can be manufactured in any manner, e.g., from an injection mold or additive manufacturing process. Larger and smaller domes 20 may be interchanged for different difficulty levels. The balance domes 20 may also be placed at different attachment points 31 on the underside of the chassis 18 to vary difficulty and balance challenges. Further, while the described embodiments depict semi-hemispherical domes 20, it is understood that the domes 20 may be implemented using other shapes, e.g., non-rounded, geodesic or other geometric 3D surfaces. Domes 20 may also include surface patterns or treads to provide a non-slip surface.

When no balance domes 20 are attached to the underside of chassis 18, exercise device 10 is configured in the glider mode. To allow for gliding (e.g., on a carpet or other flooring surface), the underside of chassis 18 comprises a smooth, rigid material, that provides relatively low friction with the flooring surface when glider exercises are performed by the user. The threaded openings 32 are either flush with the surface or recessed so as not to interfere when gliding. In certain embodiments, the underside surface of chassis 18 can be flat or can be slightly rounded or convex and include a circumferential lip 34. Lip 34 extends away from the underside of the chassis 18 to hold the footbed 12 in place and also prevents exercise device 10 from inadvertent "catching" on any a flooring surface in the glider mode.

Figure 5:
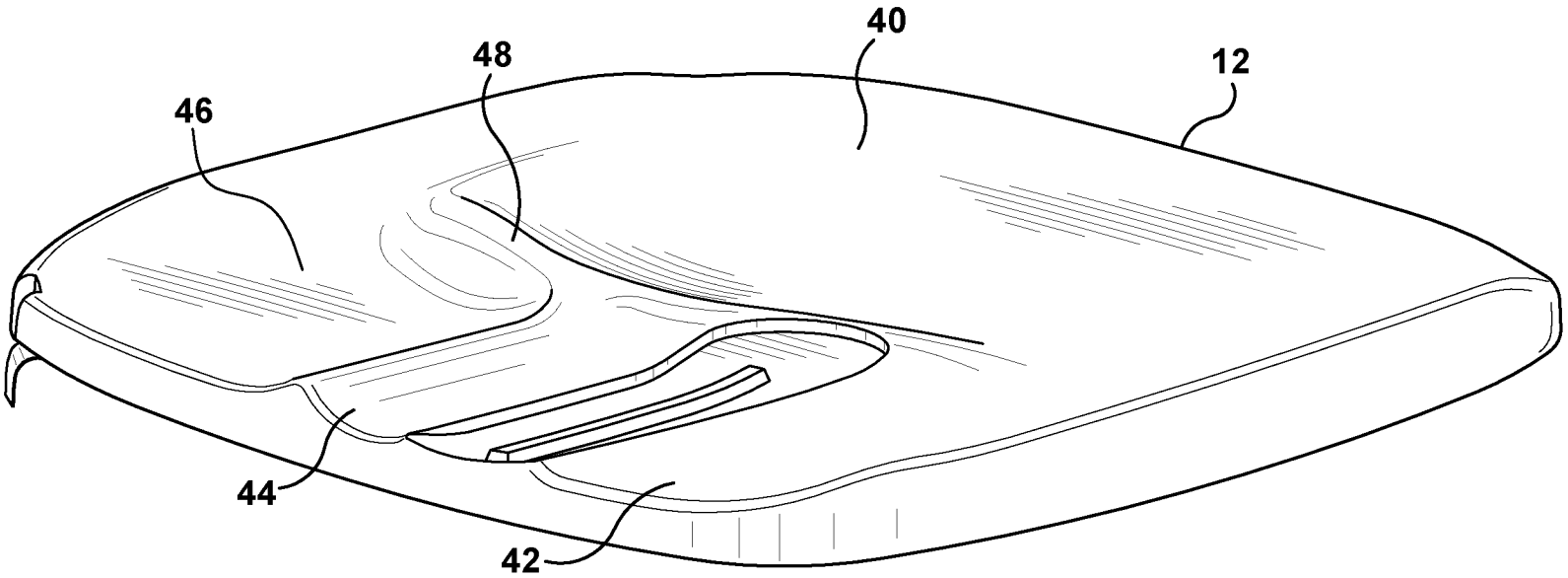
FIG. 5 shows a footbed of the exercise device according to embodiments.

FIG. 5 depicts a detailed view of the top surface of footbed 12 (without the toe separator installed). Footbed 12 may be made from any material that ideally provides support and comfort, e.g., a foam material or other highly-elastic, resilient material. Furthermore, the top surface may comprise an ergonomic design with surface contours to further promote support and comfort. In this illustrative embodiment, a first recess 40 is provided for receiving the ball of the user's foot between the toes and arch and includes a toe crest 48 over which the toes extend. A second recess 42 and third recess 44 are implemented on opposite sides of the toe separator (not shown) for receiving the first (big toe) and second toe, respectively. A fourth recess 46 is provided for receiving the third, fourth and fifth toes.

The toe separator separates the large "big toe" from the lesser toes allowing for a secure hold and proper alignment of the first toe during exercise. The toe crest 48 and ergonomic toe spaces or recesses 42, 44, 46 for toes two through five allow for improved traction, stability, and engagement of the toes during exercise.

Figure 6:
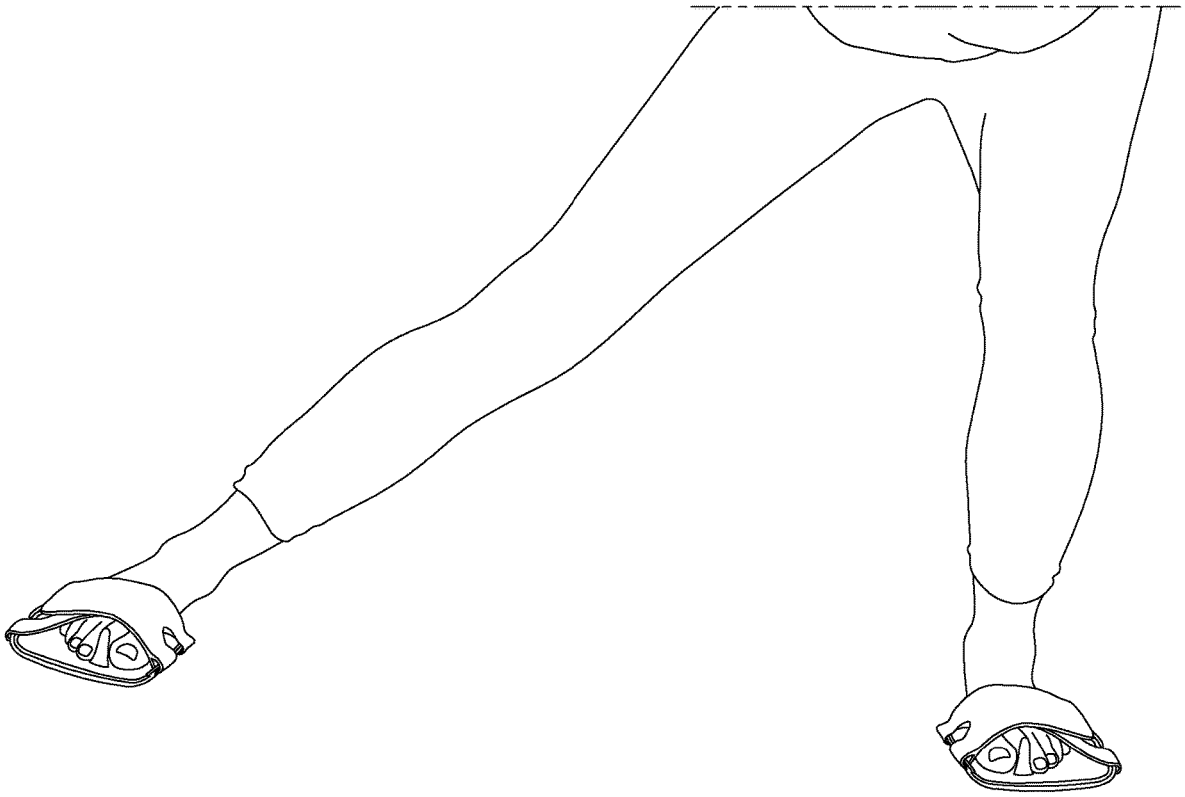
FIG. 6 depicts a pair of devices being used in a glider mode according to embodiments.

FIG. 6 depicts a user utilizing a pair of exercise devices in the glider mode. In this illustrative embodiment, the user is sliding side-to-side in a skating motion. Other illustrative glider exercises include, e.g., glider pikes, roll outs, body saws, hamstring curls, lateral lunges, etc.

Figure 7:
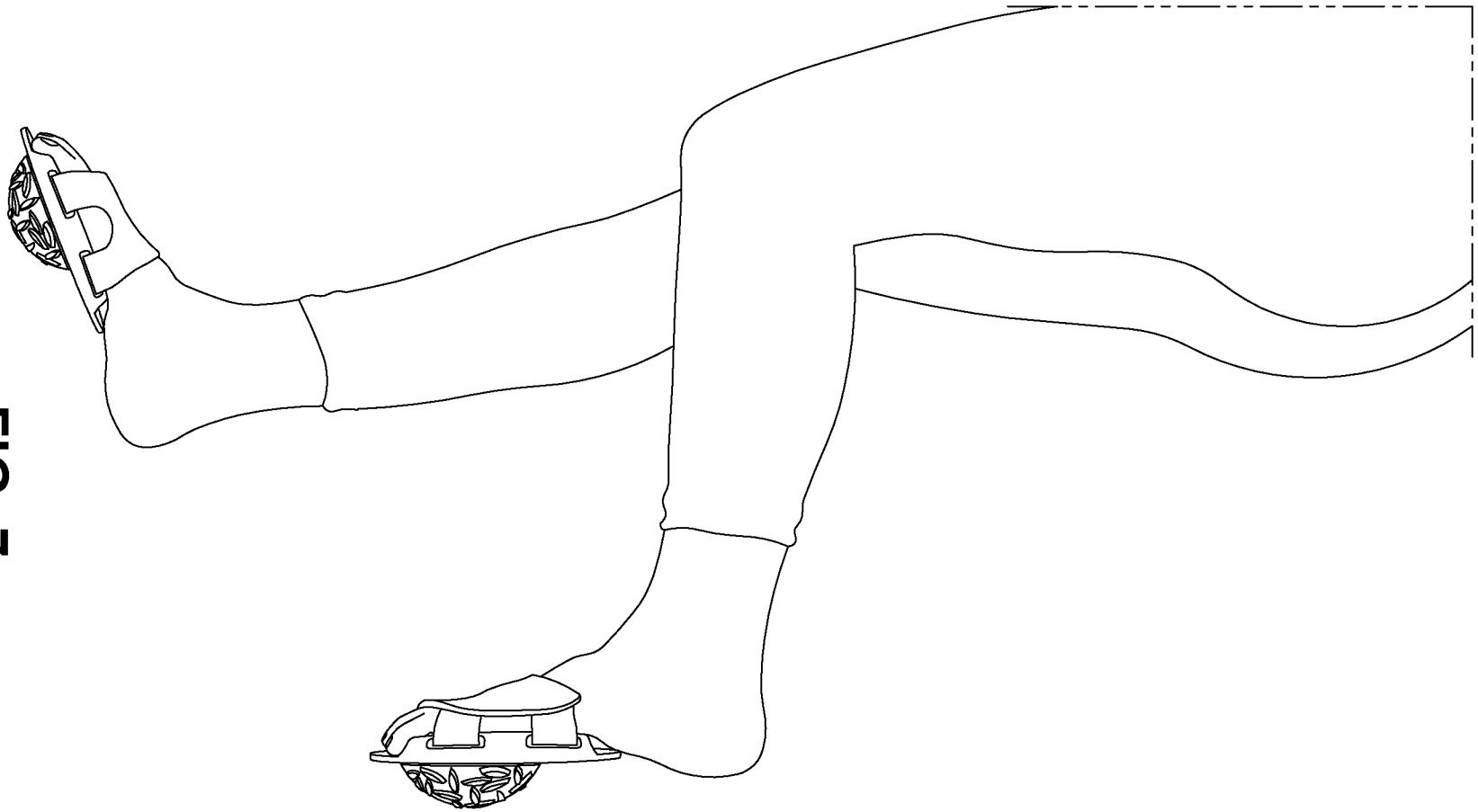
FIG. 7 depicts a pair of devices being used in a balance mode according to embodiments.

FIG. 7 depicts a user utilizing a pair of exercise devices in the balance mode. In this illustrative embodiment, the user is performing front to back tilts. Other illustrative balance board exercises include, e.g., side-to-side tilts, round-the-clock rotations, squats, calf raises, lunges, etc.

Exercise device 10 accordingly embodies a complete system for strengthening the foot and ankle appropriate for users at any age or skill level. By combining an ergonomic footbed 12 with a foot strap 70, and a chassis 18 than be configured in two modes, the user is able to perform dynamic activities instead of only static activities. Furthermore, by being barefoot the toes are engaged throughout the activity recruiting more muscles in the foot and ankle. In the balance mode, by being able to selectively add one of a plurality of different balance domes 20, many balance training exercises can be performed. Moreover, by simply removing the balance dome(s) 20, the device can be used to perform many different glider exercises.

As noted, different parts of exercise device 10 can be manufactured in any manner, e.g., via an injection mold or additive manufacturing. The underside of chassis 18, which provides the glider surface can, e.g., be made from a sheet of smooth plastic shaped and modified to allow for threaded openings 32. The balance domes 20 can, e.g., be made from an injection mold or additive manufacturing of varied densities of material with an embedded attachment fastener, e.g., threaded bolt 30 to interface with the glider surface. The straps 14 may be custom cut and sewn from flexible fabric and nylon with hook and loop attachments.

Various methods of using device 10 may be implemented as a way to improve balance, strength and foot and ankle range of motion. Further, individuals recovering from injuries such as ankle sprains or foot injuries could utilize device 10 to improve recovery. Since the present device can be used for standing on both feet at the same time, device 10 also allows for dynamic activities to help strengthen the hips, legs, and core muscles. With the feet strapped into the ergonomic footbed, the user can perform static or dynamic activities with both feet at the same time, while sitting or standing.

Due to the size and versatility of this device it also provides an extremely portable device with multiple exercise uses.

The foregoing description of various aspects of the disclosure has been presented for purposes of illustration and description. It is not intended to be exhaustive or to limit the disclosure to the precise form disclosed, and obviously, many modifications and variations are possible. Such modifications and variations that may be apparent to an individual in the art are included within the scope of the disclosure as defined by the accompanying claims.

What is claimed is:

1. An exercise device, comprising:

a footbed having a toe separator;

a chassis having a first surface mated to the footbed and a second opposed surface having a plurality of attachment points;

a strap configured to secure a foot onto the footbed; and at least one balance dome releasably attachable to a selected attachment point;

wherein the chassis includes a toe separator column extending from the first surface and wherein the footbed includes an opening through which the toe separator column extends.

2. The exercise device of claim 1, wherein the toe separator includes a cover that sits on the toe separator column.

3. The exercise device of claim 1, wherein the attachment points include a plurality of recessed openings.

4. The exercise device of claim 3, wherein the recessed openings include threaded cylinders.

5. The exercise device of claim 4, wherein the at least one balance dome includes a first planar surface with a threaded bolt extending therefrom.

6. The exercise device of claim 5, wherein the at least one balance dome includes a second opposed semi-hemispherical surface.

7. The exercise device of claim 1, further comprising a plurality of balance domes.

8. The exercise device of claim 7, wherein the plurality of balance domes have different dimensions.

9. The exercise device of claim 7, wherein the plurality of balance domes have different hardnesses.

10. The exercise device of claim 1, wherein the chassis includes anchors onto which the strap is secured.

11. The exercise device of claim 10, wherein the strap includes a pair of releasably attachable wings.

12. The exercise device of claim 11, wherein the pair of releasably attachable wings include a hook and loop fastener.

13. A method, comprising:

providing an exercise device that includes:

a footbed having a toe separator, and a chassis having a plurality of attachment points on an opposed surface from the footbed;

attaching at least one balance dome to a selected attachment point on the opposed surface;

strapping a foot onto the footbed, wherein a first toe and second toe are separated by the toe separator;

performing a balance mode exercise; and removing the at least one balance dome and attaching a different balance dome, wherein the different balance dome is at least one of a different size or hardness than the at least one balance dome.

14. The method of claim 13, wherein the at least one balance dome is attached with a threaded bolt that screws into a threaded cylinder at the selected attachment point.

15. The method of claim 14, further comprising removing the at least one balance dome and performing glider exercises.

16. An exercise device, comprising:

a footbed having a toe separator;

a chassis having a first surface mated to the footbed and a second opposed surface having a plurality of attachment points;

a strap configured to secure a foot onto the footbed; and at least one balance dome releasably attachable to a selected attachment point;

wherein the chassis includes a lip around a perimeter of the chassis that extends away from the second opposed surface.

17. An exercise device, comprising:

a footbed having a toe separator;

a chassis having a first surface mated to the footbed and a second opposed surface having a plurality of attachment points;

a strap configured to secure a foot onto the footbed; and at least one balance dome releasably attachable to a selected attachment point;

wherein the footbed includes:

a first recess configured to receive a ball of the foot;

a toe crest over which toes of the foot extend;

a second recess and third recess implemented on opposite sides of the toe separator to receive a first and a second toe, respectively; and a fourth recess configured for receiving a third toe, a fourth toe and a fifth toe.

* * * * *